US007552783B2

(12) United States Patent
Viswanadham

(10) Patent No.: US 7,552,783 B2
(45) Date of Patent: Jun. 30, 2009

(54) GRADED HARDFACING FOR DRILL BITS

(75) Inventor: Ramamurthy K. Viswanadham, Spring, TX (US)

(73) Assignee: Smith International, Inc., Houston, TX (US)

( * ) Notice: Subject to any disclaimer, the term of this patent is extended or adjusted under 35 U.S.C. 154(b) by 308 days.

(21) Appl. No.: 11/478,363

(22) Filed: Jun. 29, 2006

(65) Prior Publication Data

US 2007/0000698 A1 Jan. 4, 2007

Related U.S. Application Data

(60) Provisional application No. 60/695,975, filed on Jul. 1, 2005.

(51) Int. Cl.
*E21B 10/22* (2006.01)

(52) U.S. Cl. ..... 175/371; 175/374

(58) Field of Classification Search ..... 175/371, 175/374

See application file for complete search history.

(56) References Cited

U.S. PATENT DOCUMENTS

| | | | | |
|---|---|---|---|---|
| 3,720,274 | A | 3/1973 | McCallum | |
| 3,721,307 | A | 3/1973 | Mayo | |
| 3,917,361 | A | 11/1975 | Murdoch | |
| 3,995,917 | A | 12/1976 | Quinlan | |
| 4,054,426 | A * | 10/1977 | White | 51/309 |
| 4,260,203 | A | 4/1981 | Garner | |
| 4,273,159 | A | 6/1981 | Bolton et al. | |
| 4,323,284 | A | 4/1982 | Childers et al. | |
| 4,618,269 | A | 10/1986 | Badrak et al. | |
| 4,641,976 | A | 2/1987 | Kar | |
| 4,781,770 | A | 11/1988 | Kar | |
| 4,805,709 | A * | 2/1989 | Johnsey et al. | 175/228 |
| 4,836,307 | A | 6/1989 | Keshavan et al. | |
| 4,880,068 | A | 11/1989 | Bronson | |
| 5,501,112 | A | 3/1996 | Bernstein et al. | |
| 5,868,502 | A | 2/1999 | Cariveau et al. | |
| 5,944,127 | A | 8/1999 | Liang et al. | |
| 6,124,564 | A | 9/2000 | Sue et al. | |

(Continued)

OTHER PUBLICATIONS

Canadian Office Action issued in Application No. 2551393 dated Feb. 1, 2008 (2 pages).

(Continued)

*Primary Examiner*—Hoang Dang
(74) *Attorney, Agent, or Firm*—Osha Liang, LLP

(57) ABSTRACT

A drill bit including a bit body having an upper end adapted to be detachably secured to a drill string and at least one leg at its lower end, each leg having a downwardly and inwardly extending journal bearing, at least one roller cone mounted on each journal bearing, at least one cutting element disposed on the at least one roller cone; and a hardfacing overlay on at least a portion of at least one of an inner surface of the at least one roller cone and a surface of the journal bearing, wherein a composition of the hardfacing overlay proximate an outside surface of the hardfacing overlay is different from a composition of the hardfacing overlay proximate an interface between the hardfacing overlay and the at least a portion of at least one of the inner surface of the at least one roller cone and the surface of the journal bearing is disclosed.

25 Claims, 5 Drawing Sheets

U.S. PATENT DOCUMENTS

| | | | | |
|---|---|---|---|---|
| 6,360,832 | B1 * | 3/2002 | Overstreet et al. | 175/374 |
| 6,392,190 | B1 | 5/2002 | Sue et al. | |
| 6,615,936 | B1 | 9/2003 | Mourik et al. | |
| 6,659,206 | B2 | 12/2003 | Liang et al. | |
| 2002/0162691 | A1 * | 11/2002 | Fang et al. | 175/374 |
| 2005/0077090 | A1 * | 4/2005 | Viswanadham et al. | 175/374 |
| 2006/0185908 | A1 | 8/2006 | Kembaiyan et al. | |

OTHER PUBLICATIONS

European Communication issued in EP Application No. 06116462-1266 dated Jun. 10, 2008 (5 pages).
Extended EP Search Report issued in EP Application No. 06116462 dated Sep. 7, 2007 (6 pages).
Canadian Office Action issued in Application No. 2551393 dated Nov. 4, 2008 (2 pages).

* cited by examiner

GRADED HARDFACING FOR DRILL BITS

CROSS-REFERENCES TO RELATED APPLICATIONS

This application, pursuant to 35 U.S.C. §119(e), claims priority to U.S. Provisional Application Ser. No. 60/695,975, filed on Jul. 1, 2005. That application is incorporated by reference in its entirety.

BACKGROUND OF THE INVENTION

1. Field of the Invention

The invention relates generally to hardfacing coatings on a metallic work piece. In particular, the present invention relates to hardfacing coatings on drill bits.

2. Background Art

Rotary drill bits are generally well known in the art. These bits typically include three cone-shaped members adapted to connect to the lower end of a drill string. One example of such a drill bit is shown in FIG. 1. The bit 10 includes three individual arms 11 that extend downward from the bit body 19 at an angle with respect to the bit axis. The lower end of each arm 11 is shaped to form a spindle or bearing pin (shown as 16 in FIG. 2). A cone cutter 12, which includes a plurality of cutting elements 14, is mounted on each spindle and adapted to rotate thereon. As the drill string rotates, the cones 12 roll on the borehole bottom and rotate on about their respective spindles, thereby disintegrating the formation to advance the borehole.

FIG. 2 shows a partial, longitudinal cross section of a leg of a rock bit. Each leg includes a journal pin 16, on which a roller cone 12 is attached. During drilling, the roller cone 12 rotates around the journal pin 16. The rotation may cause the roller cone 12 to grind against the journal pin 16. Therefore, wear resistant materials are often included in critical areas on both the journal pin 16 and the inside of the roller cone 12 to minimize wear damage. In addition, bearing systems are provided to allow rotation of the cone cutter and serve to maintain the cone cutter on the spindle. These bearing systems may comprise roller bearings, ball bearings or friction bearings, or some combination of these.

As shown in FIG. 2, the journal pin 16 includes a cylindrical bearing surface having a hard metal insert 17 on a lower portion of the journal pin 16, while an open groove 18 is provided on the upper portion of the journal pin 16. Groove 18 may, for example, extend around 60% of the circumference of the journal pin 16, and the hard metal 17 can extend around the remaining 40%. The journal pin 16 also has a cylindrical nose 19 at its lower end.

The cavity (or inside surface) in the roller cone 12 typically contains a cylindrical bearing surface including an aluminum bronze insert 21 deposited in a groove in the steel of the roller cone 12 or as a floating insert in a groove in the roller cone 12. The aluminum bronze insert 21 in the roller cone 12 engages the hard metal insert 17 on the journal pin 16 and provides the main bearing surface for the roller cone 12 on the bit body. A nose button 22 is disposed between the end of the cavity in the roller cone 12 and the nose 19 of the journal pin and carries the principal thrust loads of the roller cone 12 on the journal pin 16. A bushing 23 surrounds the nose and provides additional bearing surface between the roller cone 12 and journal pin 16.

As shown in FIG. 2, a plurality of bearing balls 24 are fitted into complementary ball races in the cone and on the journal pin. The bearing surfaces between the journal pin and cone are lubricated by a grease composition. The balls 24 carry any thrust loads tending to remove the roller cone 12 from the journal pin 16 and thereby retain the roller cone 12 on the journal pin 16.

In addition, the interface between each spindle and its cone cutter may include a device (thrust bearing) to transmit thrust (axial) forces from the cone cutter to the spindle and thence to the bit. For description of various thrust bearings, see U.S. Pat. No. 5,868,502 issued to Cariveau et al. This patent is assigned to the assignee of the present invention and is incorporated by reference in its entirety.

The above described examples are greased bearing bits. The wear situation is even worse in non-lubricated open bearing bits. FIGS. 3 and 4 show partial, longitudinal cross sections of a leg of an open-bearing air bit. Referring to FIG. 3, a typical mining, roller bearing, air cooled rotary cone rock bit generally designated as 30, includes spindle 34 extending from the leg 33 forms bearing races 31 and 32 for roller bearings 35 and 36. Intermediate roller bearings 35 and 36, a plurality of ball bearings 37 rotatably retain the cone 38 on the spindle 34. Spindle 34 forms a radially disposed main bearing face 39 from which a spindle bearing 40 extends. A spindle thrust bearing disc, or "thrust button," generally designated as 41, is pressed into a bearing cone cavity or socket 42 formed in cone spindle bearing 40. Cone 38 includes an internal cavity adapted to receive spindle 34 and the bearings 35, 36, and 37. The cone cavity includes cylindrical surfaces 43 and 44, ball bearing race 37a, and socket 45. The radial end face 46 of spindle bearing 40 extends into the cone cavity adjacent cylindrical surface 44. A cone thrust bearing disc, or "thrust button," generally designated as 47, is pressed into a bearing cone cavity or socket 45 formed in cone 38. As discussed in greater detail below, cone thrust disc 47 engages spindle thrust disc 41, with the interface therebetween forming a thrust bearing.

Referring now to FIGS. 3 and 4, spindle 34 includes a main air fluid passage 48 formed in leg 33. Secondary air passages 49 direct air from main passage 48 to the main bearing face 50. An axially aligned air passage 51 directs air to a cross channel 52 that is formed in the radial end face 53 of the spindle 34. Cross channel 52 intersects and passes beneath, in this embodiment, a hardened steel bearing thrust button generally designated as 41 that is interference fitted or pressed into socket 45 formed in spindle 34. Air passes from central passage 51 into channel 52, thereby contacting base (not shown) of spindle thrust button 41. Air contacting base (not shown) of thrust button 41 serves to cool thrust button 41 and adjacent cone thrust button 47.

During operation of an open bearing, air bit, such as the one illustrated in FIGS. 3 and 4, the weight of the drill string places a load on the lower face of the cone 38. The axial component of this load generally causes contact between the radial end face or thrust face 46 of the spindle bearing 40 and the cone cavity or socket 45 formed in cone 38 on the lower, or load, side. The friction resulting from this contact between the cone 38 and the stationary support spindle 34 causes wear on the contacting surfaces that limits the useful life of the drill bit.

In greased bearing bits, the use of a lubricant on the contacting surfaces slows the rate of surface wear. However, in open bearing air bits, air is pumped through the drill pipe and through passages in the drill bit to the bearings for cooling and for keeping the bearings clean, rather than a lubricant. While air cools the outer roller bearings adequately, air cooling does not work as well in the nose area of the bit, which is subjected axial loads. The lack of lubrication and cooling on the thrust face increases heat generated by friction thereby promoting galling of the spindle and often causing premature failure of the spindle.

In addition to bearings and journal pins, the exposed, exterior parts of drill bits may also be subjected to wear. Some wear-susceptible exterior components of the drill bit include the exterior surfaces of the bit body, external surfaces of the cutting elements, and external surfaces of the roller cones on roller cone bits.

These parts, such as bit body, roller cones, and cutting elements, contact the formation during drilling and are subjected to abrasive actions. To prolong the life of a drill bit, these wear-prone surfaces should preferably be coated with a hardfacing material.

Various hardfacing materials methods are known in the art for minimizing wear on various parts of a drill bit. For example, U.S. Pat. Nos. 4,836,307 issued to Keshavan et al., and U.S. Pat. Nos. 5,944,127 and 6,659,206 both issued to Liang et al. disclose various hardfacing material compositions and particle size distributions suitable for use in hardfacing inserts, teeth, or roller cones. In addition, various methods have been developed for applying hardfacing coatings to wear prone surfaces on rock bits or inserts. These methods, for example, include thermal spraying, plasma arc welding, laser cladding, or other conventional welding methods.

Materials used in combination with the hardened steel surfaces in bit journal bearings, in provided, have included precipitation-hardened copper-beryllium (shown in U.S. Pat. Nos. 3,721,307 and 3,917,361), spinodally-hardened copper-tin-nickel (shown in U.S. Pat. No. 4,641,976), aluminum bronzes (shown in U.S. Pat. No. 3,995,917), and cobalt-based stellite alloys (shown in U.S. Pat. No. 4,323,284). These materials offer suitable ambient temperature yield strengths for use as structural elements or inlays, and acceptable anti-galling properties against hardened steel. However, at elevated PVs they can undergo a transition to high-friction operation, and except for the stellites, these alloys typically exhibit a rapid reduction in yield strength at temperatures above about 500° F. Because such high surface temperatures are not uncommon in bit thrust bearings, especially as drilling speeds have increased, if included on bit thurst surfaces, stellites have been the structural inlay material of choice for journal surfaces.

However, the effectiveness and durability of hardfacing depend on the compositions of the hardfacing materials. In addition, the compositions of the hardfacing materials also affect the strength of the bonding between the hardfacing layers and the underlying substrates. Most hardfacing compositions comprise wear-resistant particles (e.g., carbides) and a matrix metal (or alloy). Generally, altering a composition to enhance the wear resistance of the hardfacing overlay, typically results in a decrease of the fracture toughness of the overlay and reduction in the bonding strength between the hardfacing and the substrate. On the other hand, altering a composition to enhance the fracture toughness and bonding strength between the hardfacing and the substrate, typically results in a decrease in the wear resistance of the hardfacing overlay. Thus, the hardfacing materials used in the protection of drill bits or roller cones often represent a compromise between the desired properties, i.e., wear resistance, fracture toughness, and bonding strength.

Although the prior art hardfacing application techniques are capable of providing improved wear resistance to drill bits, there still exists a need for other techniques that can provide longer lasting drill bits.

SUMMARY OF THE INVENTION

In one aspect, the invention relates to a drill bit including a bit body having an upper end adapted to be detachably secured to a drill string and at least one leg at its lower end, each leg having a downwardly and inwardly extending journal bearing, at least one roller cone mounted on each journal bearing, at least one cutting element disposed on the at least one roller cone; and a hardfacing overlay on at least a portion of at least one of an inner surface of the at least one roller cone and a surface of the journal bearing, wherein a composition of the hardfacing overlay proximate an outside surface of the hardfacing overlay is different from a composition of the hardfacing overlay proximate an interface between the hardfacing overlay and the at least a portion of at least one of the inner surface of the at least one roller cone and the surface of the journal bearing.

In another aspect, the present invention relates to an open bearing drill bit that includes a bit body having an upper end adapted to be detachably secured to a drill string and at least one leg at its lower end, each leg having a downwardly and inwardly extending journal bearing, each journal bearing having an axial bearing surface and a radial bearing surface, at least one roller cone mounted on each journal bearing, at least one cutting element disposed on the at least one roller cone, and a hardfacing overlay on at least a portion of the axial bearing surface of the journal bearing, wherein a composition of the hardfacing overlay proximate an outside surface of the hardfacing overlay is different from a composition of the hardfacing overlay proximate an interface between the hardfacing overlay and the at least a portion of the axial bearing surface.

In another aspect, the present invention relates to a cutting tool for earth formation removal that includes a hardfacing overlay on at least a portion of at least one of a radial and axial load surface of the cutting tool, wherein a composition of the hardfacing overlay proximate an outside surface of the hardfacing overlay is different from a composition of the hardfacing overlay proximate an interface between the hardfacing overlay and the at least a portion of the surface of the cutting tool.

In yet another aspect, the present invention relates to a method for applying hardfacing on a cutting tool that includes forming a hardfacing overlay on at least a portion of at least one of a radial and axial load surface of the cutting tool such that a composition of the hardfacing overlay proximate an outside surface is different from a composition of the hardfacing overlay proximate an interface between the hardfacing overlay and a surface of the cutting tool.

Other aspects and advantages of the invention will be apparent from the following description and the appended claims.

DETAILED DESCRIPTION

Embodiments of the invention relate to methods for providing hardfacing to surfaces of a metal part that are likely subjected to wear in a graded manner such that the compositions of the hardfacing materials vary as a function of distance from the interface between the hardfacing overlay and the metal object. Some embodiments of the invention relate to metal objects that include graded hardfacing overlays. Being able to generate graded hardfacing overlays on a metal object makes it possible to design wear protection based on selected applications. In accordance with some embodiments of the invention, the hardfacing near the interface may have a composition designed for enhanced bonding to the metal object, while the compositions near the wear surface of the hardfacing overlay may be designed to be more wear resistant.

Figure 1:
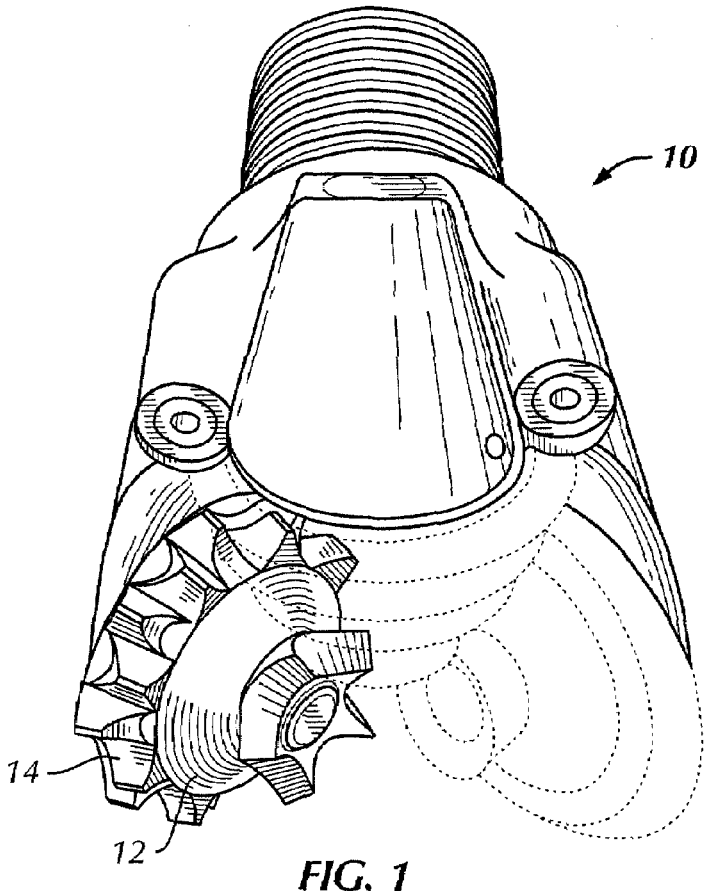
FIG. 1 (Prior Art)
FIG. 1 shows an example of a conventional milled tooth drill bit.
Figure 2:
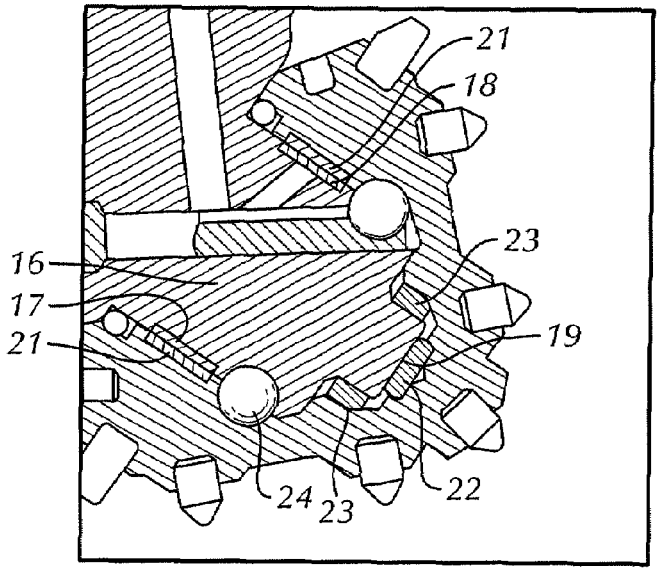
FIG. 2 (Prior Art)
FIG. 2 shows a partial cross sectional view of a leg of a conventional drill bit, illustrating the interface between a journal pin and a roller cone.
Figure 3:
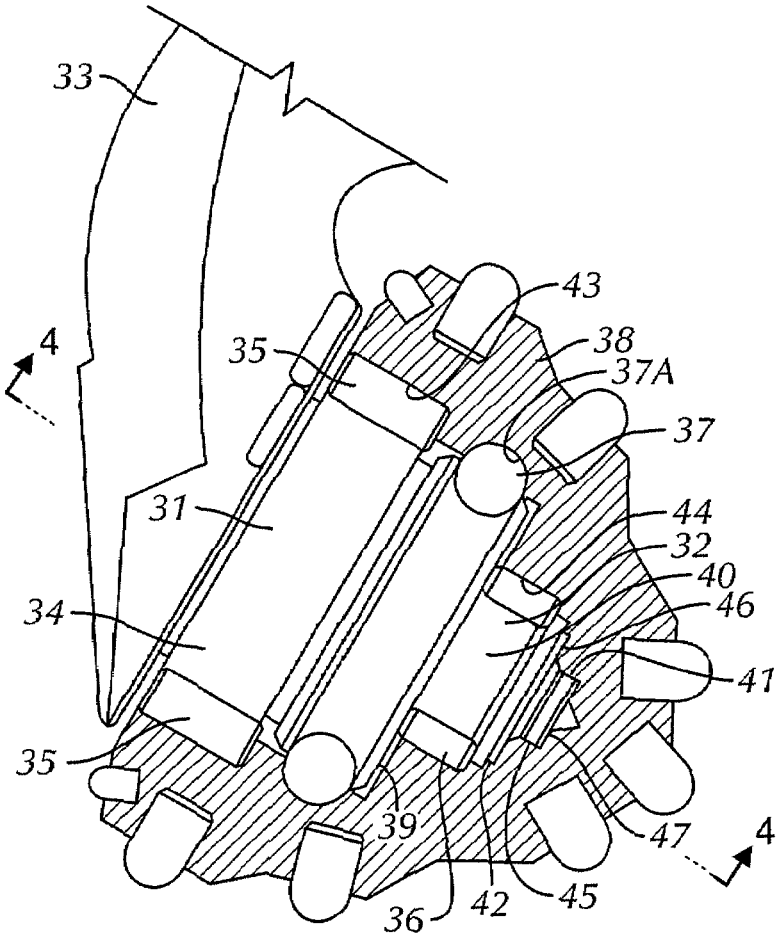
FIG. 3 shows a partial cross sectional view of a leg of a conventional air-cooled drill bit.
Figure 4:
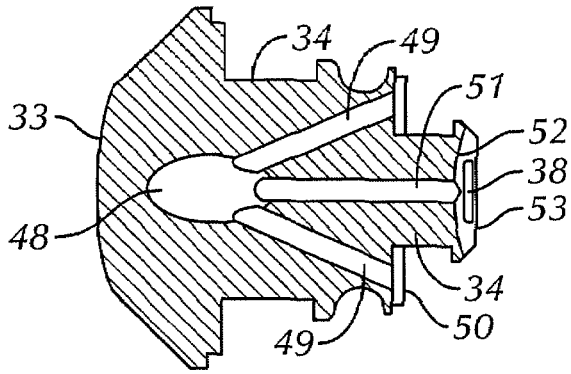
FIG. 4 is an end view taken through 4-4 of FIG. 3 illustrating the air fluid passages formed in the leg and journal bearing.
Figure 5:
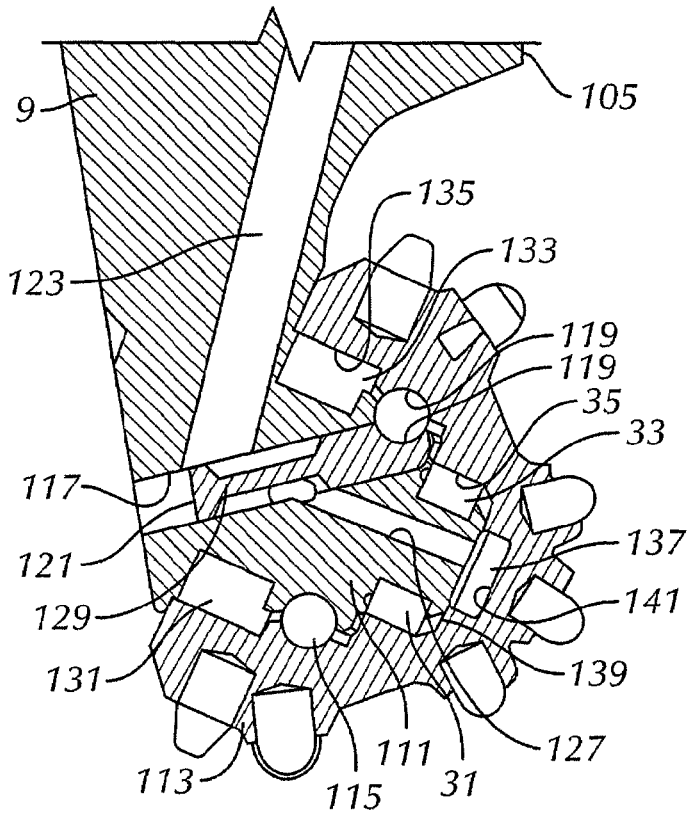
FIG. 5 shows a partial cross sectional view of a leg of a drill bit having a hardfacing overlay in accordance with one embodiment of the invention.

In a particular embodiment, the hardfacing overlay disclosed herein is provided to a bearing surface of a drill bit. FIG. 5 is a perspective view of a single leg 105 of an open-bearing air roller-cone bit in accordance with one embodiment of this invention. The lower end of leg 105 extended into a journal bearing shaft 111. Each journal bearing shaft 111 supports a roller cone 113. The end face 139 of journal bearing shaft 11 extends into the cone cavity adjacent cylindrical surface 141. The cone 113 is held on the journal bearing shaft 111 by ball elements 115 in this embodiment. A ball passage 117 extends from an outer surface of leg 105 and intersects the upper section of bearing shaft 111. The ball elements 115 are inserted through the ball passage 117 into the aligned ball grooves 119 once the cone 113 has been placed over the journal bearing shaft 111. A ball plug 121 then fills the ball passage 117 to retain the ball elements 115 in the grooves 119. Retaining rings and other retaining systems are common in the field and are also compatible with this invention.

Each leg 105 of the bit has a main air passage 123 that leads through the leg 105 to the ball passage 117. A bearing shaft air passage 127 leads from the ball passage 117 to the end of the journal bearing shaft 111. Cylindrical roller bearings 131 are located around the journal bearing shaft 111 to reduce the friction between the journal bearing shaft 111 and the cone 113. The roller bearings 131 are between the journal bearing shaft roller bearing grooves 133 and the aligned cone roller bearing grooves 135. A thrust bearing 137 may be included at the end of the journal bearing shaft 111 to handle axial loads. These bearings 131, 137 are cooled by the compressed air provided from the surface.

In one embodiment, a graded hardfacing may be provided on end face (axial bearing surface) 139 of journal bearing shaft 111, which is subjected to axial loads. In another embodiment, a graded hardfacing may be provided on other bearing surfaces, including for example, journal bearing shaft roller bearing grooves (radial bearing surface) 133 of journal bearing shaft, which is subjected to radial loads. In yet another embodiment, a graded hardfacing may be included on similar, corresponding bearing surfaces of a greased drill bit, or open bearing bits cooled by water, which do not contain air passages.

Figure 6A:
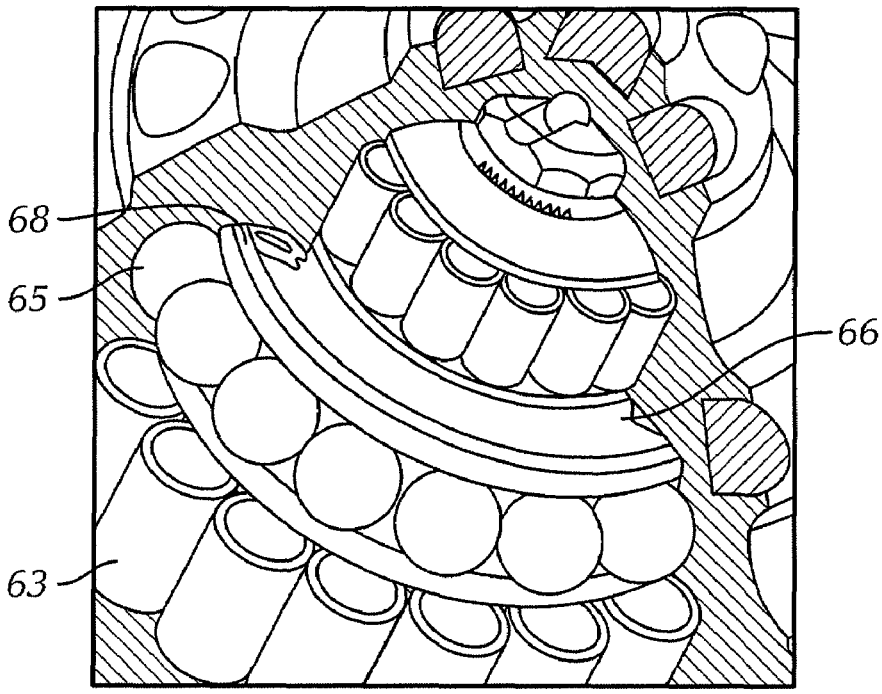
FIG. 6A and 6B show a journal bearing surface having a hardfacing overlay in accordance with one embodiment of the invention.
Figure 6B:
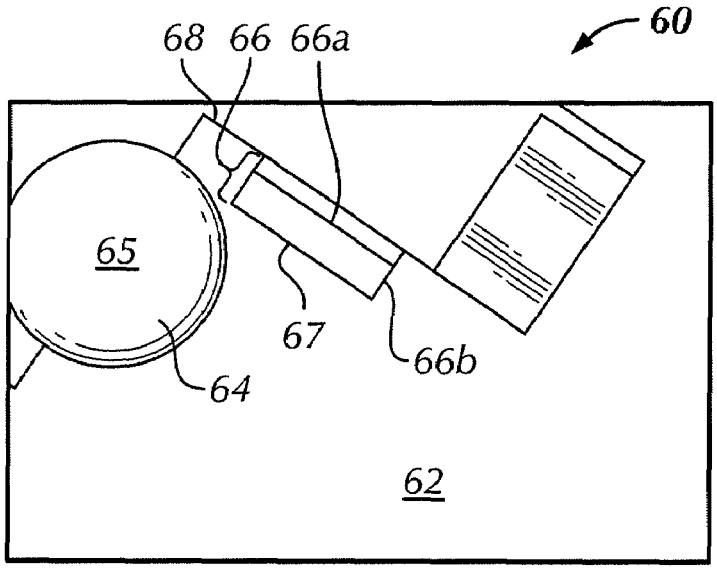

Referring to FIG. 6A and 6B, an journal bearing assembly of a drill bit according to one embodiment of the present invention is shown. Journal bearing assembly 60 includes journal bearing shaft 62, cylindrical roller bearings 63 are located around the journal bearing shaft 62, and ball elements 65 located around the ball groove 64 formed in journal bearing shaft 62. A hardfacing deposit/overlay 66 is formed in groove 67 of the axial bearing surface 68 of journal bearing shaft 62. Hardfacing deposit/overlay is a graded hardfacing overlay, where the composition of the hardfacing overlay proximate an outside surface 66*a* of the hardfacing overlay is different from a composition of the hardfacing overlay proximate an interface 66*b* between the hardfacing overlay and groove 67 in the axial bearing surface 68.

Hardfacing materials typically comprise a metal or alloy matrix and wear-resistant particles (e.g., tungsten carbides or boron nitrides). Hardfacing compositions comprising carbides are more common than boride or nitride-containing hardfacing compositions. For clarity, this description may use "carbides" (e.g., tungsten carbides, other metal carbides, or mixtures thereof) to represent general wear-resistant particles. One of ordinary skill in the art would appreciate that "carbide" particles in the hardfacing compositions may be replaced with other wear-resistant particles (e.g., borides, nitrides, carbides or mixtures) without departing from the scope of the invention. In a hardfacing overlay, the wear resistant particles are suspended in a matrix of metal. The wear resistant particles give the hardfacing overlay hardness and wear resistance, while the matrix metal (or alloy) provides fracture toughness to the hardfacing overlay. In addition, the matrix metal also contributes to the bonding between the hardfacing overlay and the metal object (thrust faces, bearing surfaces, roller cones, or cutters).

In accordance with some embodiments of the invention, hardfacing compositions variations may have lower total alloy content near the interface with the metal object, but with higher alloy contents near the wear surface. Examples of suitable alloys include the Stellite™ family of alloys sold by Deloro Stellite Co. (Goshen, Ind.). Stellite™ alloys contain cobalt, tungsten, chromium, carbon, and are known for their wear resistance and corrosion resistance at high temperatures. Alternatively, compositions of the invention may comprise a low carbide content Stellite™ near the interface between the hardfacing overlay and the metal object and change to a Stellite™ alloy with higher carbide content near the wear surface. Other examples of graded hardfacing may include a composition having varying proportions of cast and/or sintered carbide pellets in a Ni—Cr—Si matrix varying as a function of distance from the interface. The above examples of hardfacing overlays having variations in hardfacing compositions are for illustration only. One of ordinary skill in the art would appreciate that many other variations are possible without departing from the scope of the invention.

In addition, being able to have graded hardfacing makes it possible to match the thermal expansion coefficients and/or elastic modulus of the hardfacing material at or near the interface with those properties of the metal subject. For example, Stellite™ with lower alloy contents may have a better match of thermal expansion and modulus to the steel of the underlying metal article. With better matched thermal expansion coefficients and/or elastic modulus, the article will have less residual stress.

Many factors affect the durability of a hardfacing overlay on a metal object. These factors, for example, include wear resistance of the hardfacing overlay and the strength of the bonding between the hardfacing overlay and the surface of the metal object. These factors are functions of the compositions of the hardfacing materials, i.e., the material compositions and physical structure (size and shape) of the wear resistant particles, the chemical composition and microstructure of the metal or alloy, and the relative proportions of the carbides to the matrix metal or alloy. While higher proportions of the wear-resistant particles (carbide or boron nitride particles) will increase the wear resistance of the hardfacing overlay, unfortunately they decreases the fracture toughness of the hardfacing overlay and weaken the bonding between the hardfacing overlay and the metal object. On the other hand, increasing the proportions of the matrix metal can increase the fracture toughness of the hardfacing overlay and enhance the bonding between the hardfacing overlay and the metal object; however, these benefits come at the expense of the wear resistance of the hardfacing overlay. As a result, prior art hardfacing application often represents a compromise between wear resistance and fracture toughness.

In accordance with embodiments of the invention, hardfacing overlay on a metal object, such as thrust bearings, drill bits, roller cones, or cutters, may have an enhanced wear resistance without sacrificing fracture toughness or bonding strength between the hardfacing overlay and the metal object, or have an enhanced bonding between the hardfacing overlay and the metal object without sacrificing the wear resistance of the hardfacing overlay. In some embodiments of the invention, a hardfacing overlay may have both an enhanced wear resistance and an increased bonding to the surface of the metal object.

Embodiments of the invention are based on "graded" hardfacing, which has different compositions in regions close to the wear surface (i.e., outside surface) of the hardfacing overlay, as compared to regions close to the interface between the hardfacing overlay and the metal object. As used herein, "graded hardfacing" generally refers to hardfacing overlays having different compositions in regions close to the wear surface, as compared to regions close to the interface. For clarity of description, the "graded hardfacing" may be referred to as having composition variations as a function of distance from the interface between the hardfacing overlay and the metal object. However, one of ordinary skill in the area would appreciate that such variations in the hardfacing compositions may also be referenced to the wear surface or outside surface of the hardfacing overlay, or the like. In accordance with embodiments of the invention, the composition differences as a function of the distance from the interface may be gradual or stepwise. The gradual variations of the compositions may be linear or non-linear (e.g., a monotonic curve). The composition differences may be achieved during the hardfacing application process.

Embodiments of the invention may use any suitable hardfacing technique(s) known in the art to achieve hardfacing composition variations. Prior art methods that may be used with embodiments of the invention, for example, may include atomic hydrogen welding, oxyacetylene welding, plasma transfer arc ("PTA"), pulsed plasma transfer arc ("PPTA"), gas tungsten arc, shielded metal arc process, laser cladding, or the like.

Welding is among the oldest methods for application of hardfacing onto a rock bit. In a typical application, a welding tube is melted by an oxyacetylene or atomic hydrogen welding torch onto the surface of the metal object that is to be protected (e.g., a cutter, roller cone, or drill bit). The welding tube comprises a filler enclosed in a steel (or other alloy) tube, in which the filler mainly comprises carbide particles (or borides or nitrides) but may also comprise deoxidizer for steel, flux, or a resin binder. When melted, the steel (or other alloy) suspends the carbide particles in the hardfacing overlay and also helps to bond the hardfacing layer to the metal object. This steel (or other alloy) may be generally referred to as "matrix metal" or "binder alloy." In typical applications, the proportions of the filler to the steel tube may be adjusted by controlling the diameter and/or the thickness of the steel tube.

In accordance with some embodiments of the invention, the diameter and/or thickness of the steel welding tube may be varied (either gradually or stepwise) to provide different proportions of the carbide (or borides or nitrides) particles to the binder alloy. For example, the starting end of the welding tube may have a thicker wall and/or a smaller inside diameter, as compared to the other end of the welding tube, to provide a composition having a higher proportion of the binder alloy in the beginning. In accordance with other embodiments of the invention, a welding tube may have substantially the same wall thickness and/or inside diameter along its length; however, the filler therein may have different compositions (e.g., different proportions of carbide particles to binder alloy powder) along the length of the welding tube. In accordance with some embodiments of the invention, a welding rod as disclosed in U.S. Pat. No. 5,501,112 issued to Keshavan et al. may be used instead of a welding tube. This patent is assigned to the assignee of the present invention and is incorporated by reference in its entirety.

Some embodiments of the invention use laser cladding or plasma transferred arc to deposit hardfacing on the metal object. Examples of the use of laser cladding in applying hardfacing to drill bits may be found in U.S. Pat. No. 4,781,770 issued to Kar. Examples of plasma transfer arc (PTA) techniques may be found in U.S. Pat. No. 6,615,936 issued to Mourik et al., while examples of pulsed plasma transferred arc (PPTA) may be found in U.S. Pat. No. 6,124,564 issued to Sue et al. These patents are assigned to the assignee of the present invention and are incorporated by reference in their entireties. With these techniques, energy beams, i.e., laser or plasma transferred arc, may be directed to a hardfacing composition to melt the hardfacing composition onto the metal object. In accordance with embodiments of the invention, the compositions (e.g., the proportions of the carbides to the binder alloy) of the hardfacing compositions (repeated) may be varied to produce graded hardfacing. The variation in the hardfacing compositions may be gradual or stepwise depending on the desired effects.

With laser cladding or plasma transferred arc techniques, the hardfacing compositions are often fed in a powder form. When using powder injection, a mixture of carbide particles (or boride or nitride particles) and a metal matrix powder may be injected into a plasma stream or an arc. In accordance with embodiments of the invention, the hardfacing mixtures used have varying compositions. The varying compositions may be achieved, for example, by gradually or stepwise addition of one of the components (either the carbide particles or the metal matrix powder) into an initial composition, which may comprise a mixture or a single component. Alternatively, the carbide particles and the metal matrix powder may be separately injected using separate powder feeders. With this approach, the rates of the separate powder feeders may be controlled to give the desired variations in the compositions. Powder may be fed through the interior or the exterior of the torch, arc or plasma. With multiple powder feeders, some powders may be used to feed inside the torch, arc or plasma, while the remaining powders may be fed outside the torch, arc or plasma.

Another method of feeding a hardfacing composition is by use of a wire or a rod, as disclosed in U.S. Pat. No. 5,501,112 issued to Keshavan et al. The wire or rod may be made of a hardfacing composition (i.e., a mixture). Alternatively, the wire may be made of a matrix metal, and the outside of the wire is coated with the carbide particles, or vice versa. In accordance with embodiments of the invention, the compositions of the wires or rods are varied along the length so that the finished hardfacing overlay will have graded compositions. In some embodiments, multiple wires or rods may be used to achieve the variations in the hardfacing compositions. When multiple wires or rods are used, the variation in the hardfacing compositions may be achieved by different rates of feeding separate wires or rods, each of which may comprise a different component or composition, or by using wires or rods having different compositions along their lengths. The wires or rods may be fed inside or outside a hardfacing torch, arc or plasma.

Figure 7:
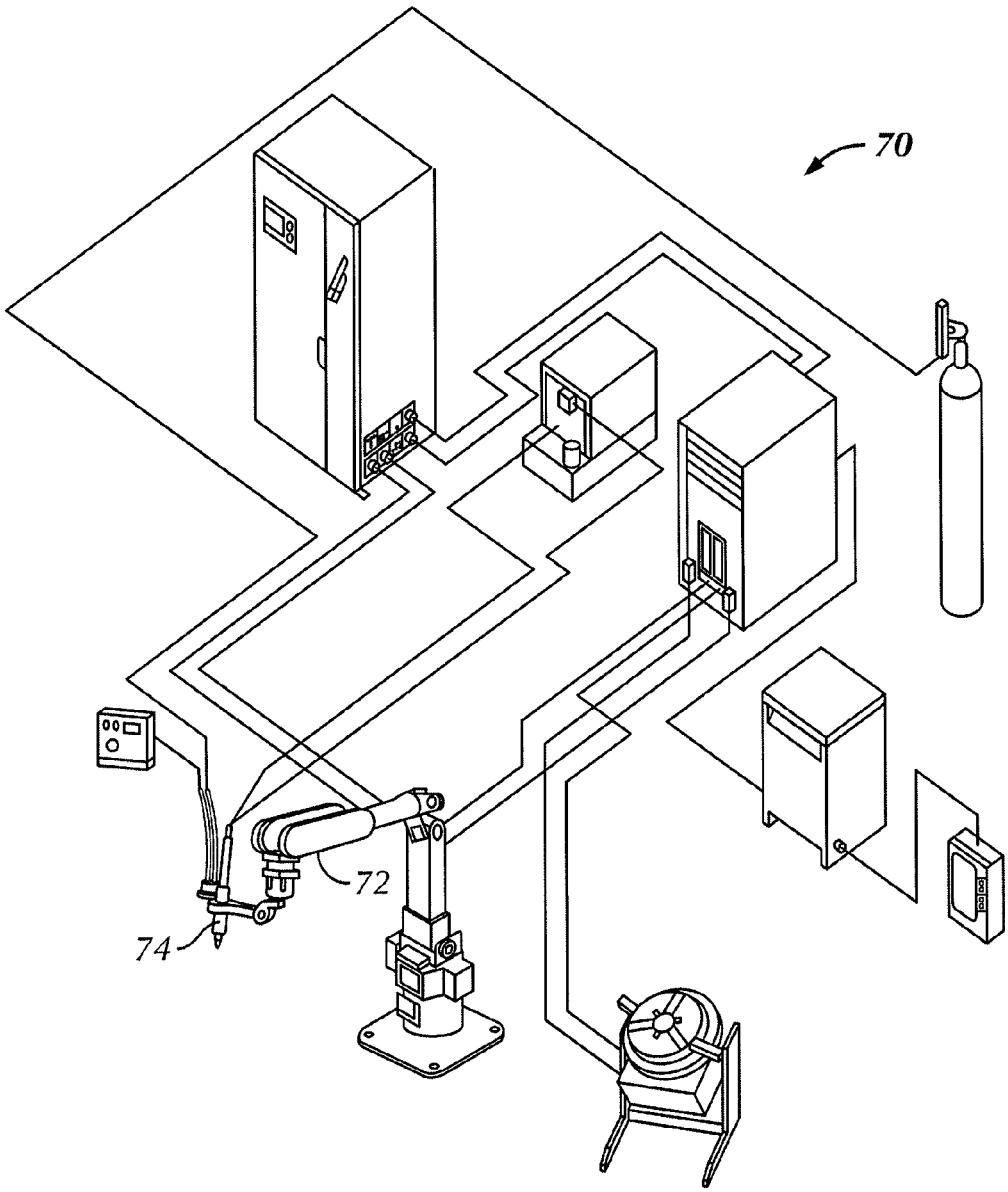
FIG. 7 (Prior Art)
FIG. 7 shows a schematic of a prior art automatic hardfacing system.

Any apparatus adapted to apply hardfacing known in the art may be used with embodiments of the invention. For example, the automated hardfacing system disclosed in U.S. Pat. No. 6,392,190 issued to Sue et al. may be used with methods of the invention. This patent is assigned to the assignee of the present invention and is incorporated by reference in its entirety. FIG. 7 shows an automatic hardfacing system disclosed in this patent, which includes a computer-controlled robotic arm 72 for positioning a plasma transferred arc welding apparatus 74 (or other welding apparatus). The automatic system 70 can also control the hardfacing powder flow rates to produce the desired hardfacing overlay. This system can also feed multiple wires/rods or vary the wire/rod feeding speeds.

A method in accordance with embodiments of the invention may include a step of determining the pattern of hardfacing composition variations desired for the metal object (e.g., a thrust surface, bearing surface, a roller cone or a cutting element) and then applying the hardfacing material according to the desired variations. For example, the composition variations may be gradual or stepwise. The composition variations may produce more binder alloy near the interface as compared to the wear surface. Once the variation pattern is determined, a hardfacing overlay may be deposited onto the metal object according to the pattern of composition variation. To achieve the desired pattern, appropriate hardfacing compositions are used. The forming of the hardfacing overlay may use any techniques known in the art.

Figure 8:
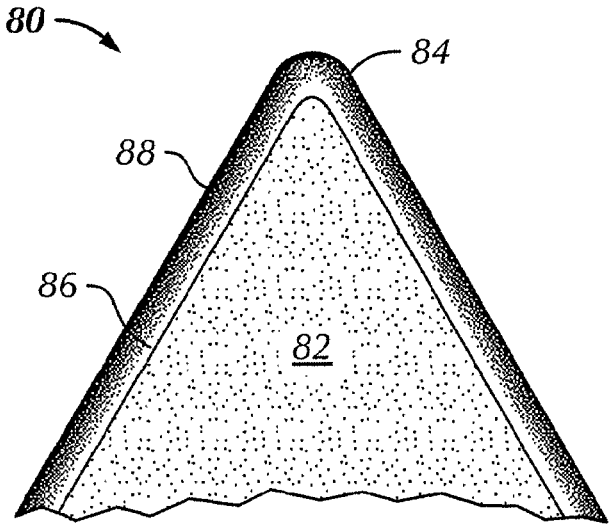
FIG. 8 shows a milled tooth having a hardfacing overlay in accordance with one embodiment of the invention.

Embodiments of the present invention may also find use in any downhole cutting application in which there exists metal-to-metal contact that may result in wear failure. Further, while the present disclosure refers to components of a drill bit, it is expressly within the scope of the present invention, that the graded hardfacing overlays disclosed herein may be used in other downhole cutting tools including, for example, reamers, continuous miners, or other components of drill bits. One of skill in the art would recognize that cutting tools that may be provided with the graded hardfacing disclosed herein are not necessarily limited to tools using in oil and gas exploration, but rather include all types of cutting tools used in drilling and mining. For example, some embodiments of the invention relate to cutting elements, roller cones or drill bits having graded hardfacing overlays. FIG. 8 shows an exemplary cutter 80 having a steel body 82 and a hardfacing overlay 84. The hardfacing overlay 84 has a composition near the interface 86 that is different from a composition near the wear surface 88. For example, the composition near the wear surface 88 may be rich in carbides, while the composition near the interface 86 may be rich in matrix metal. Additionally, a graded hardfacing may be applied to cutting elements such as those described in the U.S. Patent Application entitled, "Assymetrical Graded Composite for Improved Drill Bits," filed concurrently herewith, which is herein incorporated by reference in its entirety.

While this example shows a gradual variation of the hardfacing compositions, other embodiments of the invention may have stepwise variations in the hardfacing compositions. Furthermore, while a cutting element is shown for illustration, other embodiments of the invention may include other drill bit components or other cutting toolds having graded hardfacing.

Advantageously, embodiments of the present invention provide methods for producing bearing surfaces of drill bits having graded hardfacing overlays. In addition, methods of the invention can provide components of cutting tools and/or drill bits that include graded hardfacing overlays. An axial bearing surface having graded hardfacing overlays may allow for a hardfacing that provides both increased wear resistance and fracture toughness and/or increased bonding of the hardfacing overlays to the steel journal bearing. Methods of the invention permit the use of lower cost material near the interface between the hardfacing overlay and the metal object, reducing the cost of the hardfacing products. Being able to form graded hardfacing overlays makes it possible to tailor the coated substrate to the desired properties, such as enhanced wear resistance, and/or allow for enhanced bonding to the metal object, extending the life of the metal substrate.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body having an upper end adapted to be detachably secured to a drill string and at least one leg at its lower end, each leg having a downwardly and inwardly extending journal bearing;

at least one roller cone mounted on each journal bearing;

at least one cutting element disposed on the at least one roller cone; and a hardfacing overlay on at least a portion of at least one of an inner surface of the at least one roller cone and a surface of the journal bearing, wherein a composition of the hardfacing overlay proximate an outside surface of the hardfacing overlay is different from a composition of the hardfacing overlay proximate an interface between the hardfacing overlay and the at least a portion of at least one of the inner surface of the at least one roller cone and the surface of the journal bearing.

2. The drill bit of claim 1, wherein the journal bearing has a radial bearing surface and an axial surface, and wherein the hardfacing overlay is on at least a portion of at least one of the radial bearing surface and axial bearing surface.

3. The drill bit of claim 1, wherein compositions of the hardfacing overlay vary as a function of distance from the interface between the hardfacing overlay and the surface of the bearing journal.

4. The drill bit of claim 1, wherein the compositions of the hardfacing overlay vary in a gradual manner.

5. The drill bit of claim 1, wherein the compositions of the hardfacing overlay vary in a stepwise manner.

6. The drill bit of claim 1, wherein the compositions of the hardfacing overlay vary in alloy content.

7. The drill bit of claim 1, wherein the compositions of the hardfacing overlay comprise carbide particles, boride particles, nitride particles, or a mixture of these particles.

8. The drill bit of claim 1, further comprising a hardfacing overlay on at least one of the bit body, the at least one roller cone, and the at least one cutting element, wherein a composition of the hardfacing overlay proximate an outside surface of the hardfacing overlay is different from a composition of the hardfacing overlay proximate an interface between the hardfacing overlay and the at least a portion of the surface of the at least one of the bit body, the at least one roller cone, and the at least one cutting element.

9. An open bearing drill bit, comprising;

a bit body having an upper end adapted to be detachably secured to a drill string and at least one leg at its lower end, each leg having a downwardly and inwardly extending journal bearing, each journal bearing having an axial bearing surface and a radial bearing surface;

at least one roller cone mounted on each journal bearing;

at least one cutting element disposed on the at least one roller cone; and a hardfacing overlay on at least a portion of the axial bearing surface of the journal bearing, wherein a composition of the hardfacing overlay proximate an outside surface of the hardfacing overlay is different from a composition of the hardfacing overlay proximate an interface between the hardfacing overlay and the at least a portion of the axial bearing surface.

10. The open bearing drill bit of claim 9, further comprising:

at least one air passage extending through each leg and journal bearing to an interface of least one roller cone and journal bearing.

11. A cutting tool for earth formation removal, comprising:

a hardfacing overlay on at least a portion of at least one of a radial and axial bearing surface of the cutting tool, wherein a composition of the hardfacing overlay proximate an outside surface of the hardfacing overlay is different from a composition of the hardfacing overlay proximate an interface between the hardfacing overlay and the at least a portion of the surface of the cutting tool.

12. The cutting tool of claim 11, wherein the cutting tool comprises a raised boring device.

13. The cutting tool of claim 11, wherein the cutting tool comprises a tunnel boring device.

14. The cutting tool of claim 11, wherein the cutting tool comprises a reamer.

15. The cutting tool of claim 11, wherein the cutting tool comprises a drill bit.

16. A method for applying hardfacing on a cutting tool, comprising:

forming a hardfacing overlay on at least a portion of at least one of a radial and axial bearing surface of the cutting tool;

such that a composition of the hardfacing overlay proximate an outside surface is different from a composition of the hardfacing overlay proximate an interface between the hardfacing overlay and a surface of the cutting tool.

17. The method of claim 16, wherein the cutting tool comprises a drill bit having a journal bearing comprising an axial bearing surface and a radial bearing surface, and the hardfacing overlay is formed on at least a portion of at least one of the axial bearing surface and the radial axial surface.

18. The method of claim 17, wherein the hardfacing overlay is formed on at least a portion of the axial bearing surface.

19. The method of claim 16, wherein compositions of the hardfacing overlay vary as a function of distance from the interface between the hardfacing overlay and the metal object.

20. The method of claim 19, wherein the compositions of the hardfacing overlay vary in a gradual manner.

21. The method of claim 20, wherein the compositions of the hardfacing overlay vary in a stepwise manner.

22. The method of claim 20, wherein the compositions of the hardfacing overlay vary in alloy content.

23. The method of claim 16, wherein the compositions of the hardfacing overlay comprise carbide particles, boride particles, nitride particles, or a mixture of these particles.

24. The method of claim 16, wherein the forming is performed by a technique selected from laser cladding, plasma transferred arc, pulsed plasma transferred arc, gas tungsten arc, shielded metal arc, atomic hydrogen welding, and oxyacetylene welding.

25. The method of claim 16, wherein the forming comprises welding a first pass of hardfacing overlay and welding a second pass of hardfacing overlay.

* * * * *